US012421821B1

(12) United States Patent
Atkins et al.

(10) Patent No.: US 12,421,821 B1
(45) Date of Patent: Sep. 23, 2025

(54) DOWNHOLE TOOL FOR SELECTIVELY CATCHING BALLS IN A WELLBORE

(71) Applicant: Schlumberger Technology Corporation, Sugar Land, TX (US)

(72) Inventors: James Edward Atkins, Aberdeen (GB); Seweryn Wrozyna, Aberdeen (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/733,991

(22) Filed: Jun. 5, 2024

(51) Int. Cl.
*E21B 27/00* (2006.01)

(52) U.S. Cl.
CPC ..... *E21B 27/00* (2013.01)

(58) Field of Classification Search
CPC ..... E21B 34/142; E21B 27/00; E21B 23/0413
See application file for complete search history.

(56) References Cited

U.S. PATENT DOCUMENTS 6,220,360 B1 * 4/2001 Connell ..... E21B 23/04 166/373
7,530,400 B2 5/2009 Telfer
9,617,816 B1 * 4/2017 Sullivan ..... E21B 31/00
11,332,990 B2 * 5/2022 Strilchuk ..... E21B 34/14
2010/0307832 A1 * 12/2010 Mock ..... E21B 23/042 175/99
2011/0278017 A1 * 11/2011 Themig ..... E21B 34/142 166/194
2012/0073827 A1 * 3/2012 Kenyon ..... E21B 34/107 166/373
2013/0118732 A1 * 5/2013 Chauffe ..... E21B 34/06 166/250.04
2014/0041876 A1 * 2/2014 Fleckenstein ..... E21B 43/14 166/329
2015/0218904 A1 * 8/2015 Chauffe ..... E21B 33/129 166/54.5
2020/0149363 A1 * 5/2020 Cho ..... E21B 41/0035
2022/0178227 A1 * 6/2022 Lee ..... E21B 41/0078
2023/0167711 A1 * 6/2023 McCarthy ..... E21B 34/142 166/386
2023/0340848 A1 * 10/2023 Atkins ..... E21B 33/068

* cited by examiner

*Primary Examiner* — Shane Bomar

(57) ABSTRACT

A ball catcher tool for catching and retaining drop balls in a tool string includes a body having a central bore extending therethrough and a first channel that extends within the central bore. The first channel has an opening that is configured to receive at least one ball for retention in the first channel. The tool further includes a retractable ball retainer with a retainer element configured to move between an extended position and a retracted position by movement of a ball past the retainer element. The retainer element includes a front surface and a rear surface that are configured in the extended position to extend into the first channel with the front surface extending at an acute angle relative to an inside surface that forms the first channel and away from the opening of the first channel. The acute angle of the front surface can limit erosion of the retractable ball retainer due to high velocity fluid flow through the tool.

19 Claims, 6 Drawing Sheets

DOWNHOLE TOOL FOR SELECTIVELY CATCHING BALLS IN A WELLBORE

FIELD

The present invention relates to downhole tools for use in oil and gas wells and in particular, though not exclusively, to a downhole tool for selectively catching drop balls in a wellbore.

BACKGROUND

It is well known in the art to use drop balls to perform functions within a wellbore. Resilient balls, typically made of rubber, have been used to wipe the inner surface of the wellbore or tool string as the ball moves downwardly or to separate fluids. Hard balls, typically made of steel, are used to reset tools by blocking flow through the tool and by a buildup of pressure, causing movement of one part of the tool in relation to another. An example of such a tool is a circulation tool, wherein radial ports are provided in the tool body and in a sleeve within the tool body. The sleeve is fixed in position with the ports misaligned so that fluid flow is initially through a central bore of the tool. A drop ball is released into the tool string and by sealing against the sleeve, causes the sleeve to move relative to the body. This movement causes the radial ports to align and fluid is jetted radially from the tool. The tools have been improved to include mechanisms where the ball can fall through the tool so that the tool can be cyclic in operation.

Once a ball is released from a tool or has completed its function in a wellbore, it is desirable to catch or retain the ball in the tool string so that it may be brought back up to the surface. Simple ball catchers merely comprise a bar or pin extending across the central bore of the tool string providing a bypass for fluid but preventing the balls from travelling any further. The main disadvantage of such catchers are that after a number of balls are caught, the fluid flow is impeded as the fluid has to travel in a tortuous path around the balls.

FIG. 1 illustrates a prior art ball catcher tool 10 that includes a substantially cylindrical body or mandrel 12 having an upper end 14 a lower end 16 with a cylindrical bore 18 extending between the upper end 14 and the lower end 16. In the embodiment shown, bore 18 extends centrally through the tool 10. The body 12 has a box section 20 located at the upper end 14 and a pin section 22 located at the lower end 16 for connecting the tool 10 in a tool string, work string or drill string (not shown).

The bore 18 supports an inner sleeve or body 24 disposed within the bore 18. The inner sleeve 24 includes two channels, a first channel 26 and a second channel 28. The first channel 26 is an elongate cavity or bore having a diameter sized to receive a larger size ball (e.g., a ball having a diameter in the range of 1.375" to 1.76") for movement and storage therein. The first channel 26 extends between an entrance 30 and a ball stop or restrictor 32. The length of the channel between the entrance 30 and the ball stop 32 can be configured to store a number of the larger size balls within the first channel 26. The second channel 28 is an elongate cavity or bore configured to allow for passage of smaller size ball(s) through the second channel 28 and through the lower part of bore 18 to the lower end 16 and out the tool 10. The smaller size ball(s) have a diameter less than the diameter of the larger size ball that is caught by the first channel 26 (e.g., a maximum diameter of 1.25"), The first and second channels 26, 28 can also include one or more openings or connections that allow for smaller size ball(s) that enter the first channel 26 to pass into and through the second channel 28 for passage through the tool 10. These openings or connections can also allow for fluid that enters the first channel 26 to pass into and through the second channel 28 for passage through the tool 10.

The upper end of the sleeve 24 includes a ball diverter 34 that operates to divert larger size balls and possibly smaller size balls to the first channel 26. In embodiments, the ball diverter 30 can include a plate that extends across the top of the first and second channels 26, 28. The plate is inclined relative to the central axis of the bore 18. The low side of the plate is positioned above the first channel 26, and the high side of the plate is positioned above the second channel 28. In this way any ball landing on the plate will fall towards the lower side and the first channel 26. The plate can further include two circular apertures. One aperture is aligned with the first channel 26 and has a diameter corresponding to the diameter of the first channel 26. This aperture allows for passage of both the larger size ball and possibly the smaller size ball therethrough. The other aperture is aligned with the second channel 28 and sized to allow for passage of the smaller size ball therethrough (but does not allow for passage of the larger size ball).

The larger-size ball(s) that enter the first channel 26 are retained at the lower end of the first channel 26 by the ball stop 32. A retractable ball retainer 36 is disposed at or near the entrance 30 of the first channel 26. As described below with respect to FIG. 2, the retainer 36 is configured to pivot between an extended position and a retracted position by movement of a ball past the retainer 36. In the extended position, part of the retainer 36 that extends into the first channel 26 retains larger-size ball(s) that enter the first channel 26 at the upper end of the first channel 26.

Though the channels 26, 28 are shown parallel to, but off-set from the central axis of the bore 18, it will be appreciated that the channels 26, 28 can be located anywhere in the bore 18. Thus, in a further embodiment, the second channel 28 can be located centrally and co-axially with the bore 18 to provide a central passage running axially through the ball catcher tool 10. This central passage can provide for the passage of tools through the ball catcher tool 10.

In use, the ball catcher tool 10 can be located in a tool string using the box section 20 and the pin section 22. Fluid can pass through the ball catcher tool 10 using the central bore 18 and the channels 26, 28. Thus, an unimpeded flow path can be provided for the fluid.

When a ball enters the ball catcher 10 at the upper end 14, its movement can be guided by the ball diverter 34. For a larger-size ball, the ball diverter 34 guides movement of the ball to the entrance 30 of the first channel 26. At the lower end of the first channel 26, the larger size ball will be retained within the first channel 26 by the ball stop 32 as shown in FIG. 1. For a smaller-size ball, the ball diverter 34 guides movement of the ball to the entrance 30 of the first channel 26 or into the second channel 28. In the event that the smaller size ball enters the first channel 26, the openings or connections between the first and second channels 26, 28 permits the smaller size ball to pass into and through the second channel 28. In either case, the smaller size ball will pass through the tool 10.

Thus, the passage of a ball through the ball catcher tool 10 or the capture of the ball by the ball catcher tool 10 is selectively determined based on the size of the ball.

FIG. 2 illustrates details of the retractable ball retainer 36 of the prior art ball catcher tool of FIG. 1, which includes a retainer block 38 that is configured to pivot about a pivot pin 40 mounted within a compartment or void space formed in the sleeve 24. The retainer block 38 is formed from a high strength stainless steel. The retainer block 38 is configured to pivot between an extended position and a retracted position by movement of a ball past the retainer block 38. The retainer block 38 is spring-biased to assume the extended position where part of the retainer block 38 extends into the first channel 26. In this extended position, the front surface 42 and rear surface 44 of the retainer block 40 extend beyond an inside surface 46 of the sleeve 24 into the first channel 26. The part of the retainer block 38 that mounts to the pivot pin 40 is disposed within the compartment or void space formed in the sleeve 24. The rear surface 44 retains larger-size ball(s) that enter the first channel 26 at the upper end of the first channel 26. As a moving ball enters the entrance 30 of the first channel 26, it contacts the front surface 42 of the retainer block 38. The kinetic energy of the moving ball causes the retainer block 38 to pivot about the pivot pin 40 into the retracted position within the compartment or void space formed in the sleeve 24, which permits the ball to move pass the retainer block 38 and through the first channel 26. After the moving ball moves past the retainer block 38, the spring-bias applied to the retainer block 38 returns the retainer block to the extended configuration.

In the extended configuration of the retractable ball retainer 36, the front surface 42 of the retainer block 38 is oriented perpendicular to the central axis 50 of the first channel 26 as shown in FIG. 2. This configuration can result in erosion of the retainer block 38 and the pivot pin 40 due to high velocity fluid flow through the tool 10, and the erosion can result in failure of the retractable ball retainer 36.

SUMMARY

An improved ball catcher tool for catching and retaining drop balls in a tool string is provided that includes a body having a central bore extending therethrough with a first channel that extends within the central bore. The first channel has an opening that is configured to receive at least one ball for retention in the first channel. The tool further includes a retractable ball retainer that includes a retainer element configured to move between an extended position and a retracted position by movement of a ball past the retainer element. The retainer element includes a front surface and a rear surface that are configured in the extended position to extend into the first channel with the front surface extending at an acute angle relative to an inside surface that forms the first channel and away from the opening of the first channel.

In embodiments, the acute angle of the front surface can limit erosion of the retractable ball retainer due to high velocity fluid flow through the tool.

In embodiments, the acute angle of the front surface can be in the range of 20 degrees to 45 degrees.

In embodiments, the rear surface of the retainer element can be configured in the extended position to extend into the first channel perpendicular to the inside surface that forms the first channel.

In embodiments, the front surface and the rear surface of the retainer element can be generally planar in form in the shape of a wedge.

In embodiments, the retainer element can be configured in the retracted position to move into a compartment or void space. The compartment or void space can be accessible by an open wall that is covered by a removable plate. The removable plate can limit erosion of the retractable ball retainer due to high velocity fluid flow through the tool.

In embodiments, the retainer element can be configured to pivot between the extended position and retracted position about a pivot pin mounted within the compartment or void space.

In embodiments, the retractable ball retainer can include a spring that is held and captured by the pivot pit within the compartment or void space. The spring can be configured to interface to the retainer element and apply a spring-bias force to the retainer element that biases the retainer element to assume the extended position where part of the retainer element extends into the first channel.

In embodiments, the retainer element can be formed from tungsten carbide to limit erosion of the retractable ball retainer due to high velocity fluid flow through the tool.

In embodiments, the tool can further include a ball diverter disposed within the central bore. The ball diverter can be configured to direct at least one ball that is received by the tool to the first channel. The tool can further include a ball stop disposed at an end of the first channel.

In embodiments, the tool can further include a second channel that extends within the central bore. The first channel can be configured to retain at least one larger size ball in the first channel. The second channel can be configured to permit passage of at least one smaller size ball therethrough.

In embodiments, the first and second channels can be defined by an internal sleeve disposed within the central bore. At least one opening or passage can be provided between the first and second channels that permits passage of at least one smaller size ball from the first channel into the second channel.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

The subject disclosure is further described in the detailed description which follows, in reference to the noted plurality of drawings by way of non-limiting examples of the subject disclosure, in which like reference numerals represent similar parts throughout the several views of the drawings, and wherein.

DETAILED DESCRIPTION

The particulars shown herein are by way of example and for purposes of illustrative discussion of the embodiments of the subject disclosure only and are presented in the cause of providing what is believed to be the most useful and readily understood description of the principles and conceptual aspects of the subject disclosure. In this regard, no attempt is made to show structural details in more detail than is necessary for the fundamental understanding of the subject disclosure, the description taken with the drawings making apparent to those skilled in the art how the several forms of the subject disclosure may be embodied in practice. Furthermore, like reference numbers and designations in the various drawings indicate like elements.

Figure 1:
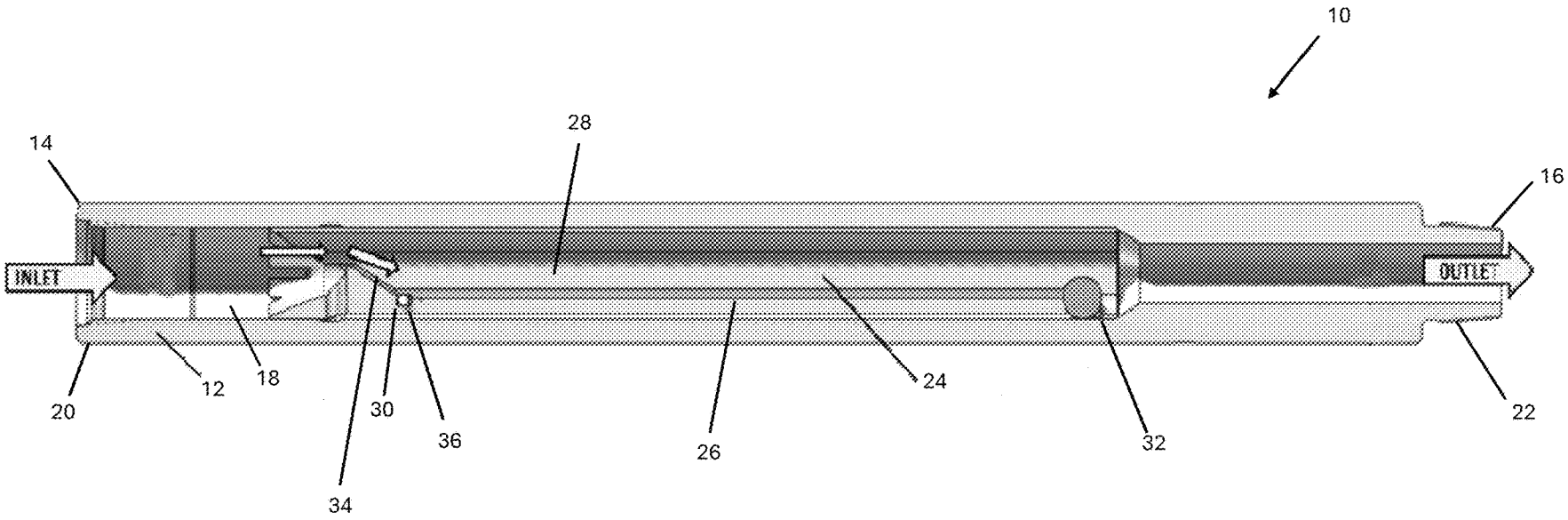
FIG. 1 (PRIOR ART)
FIG. 1 is a cross-sectional view of a prior art ball catcher tool.
Figure 2:
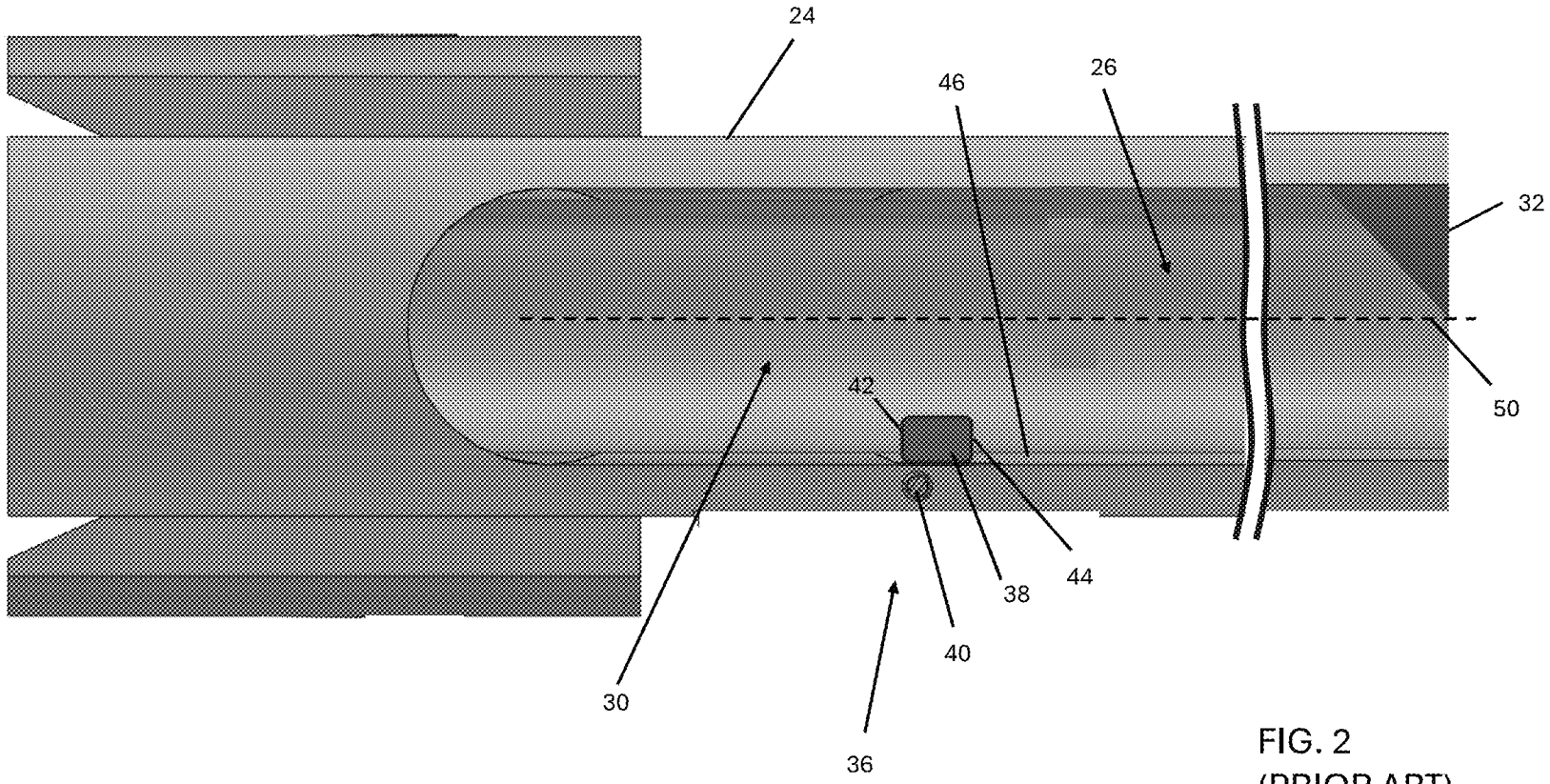
FIG. 2 (PRIOR ART)
FIG. 2 is a cross-sectional view of part of the prior art ball catcher tool of FIG. 1, including a retractable ball retainer.
Figure 3:
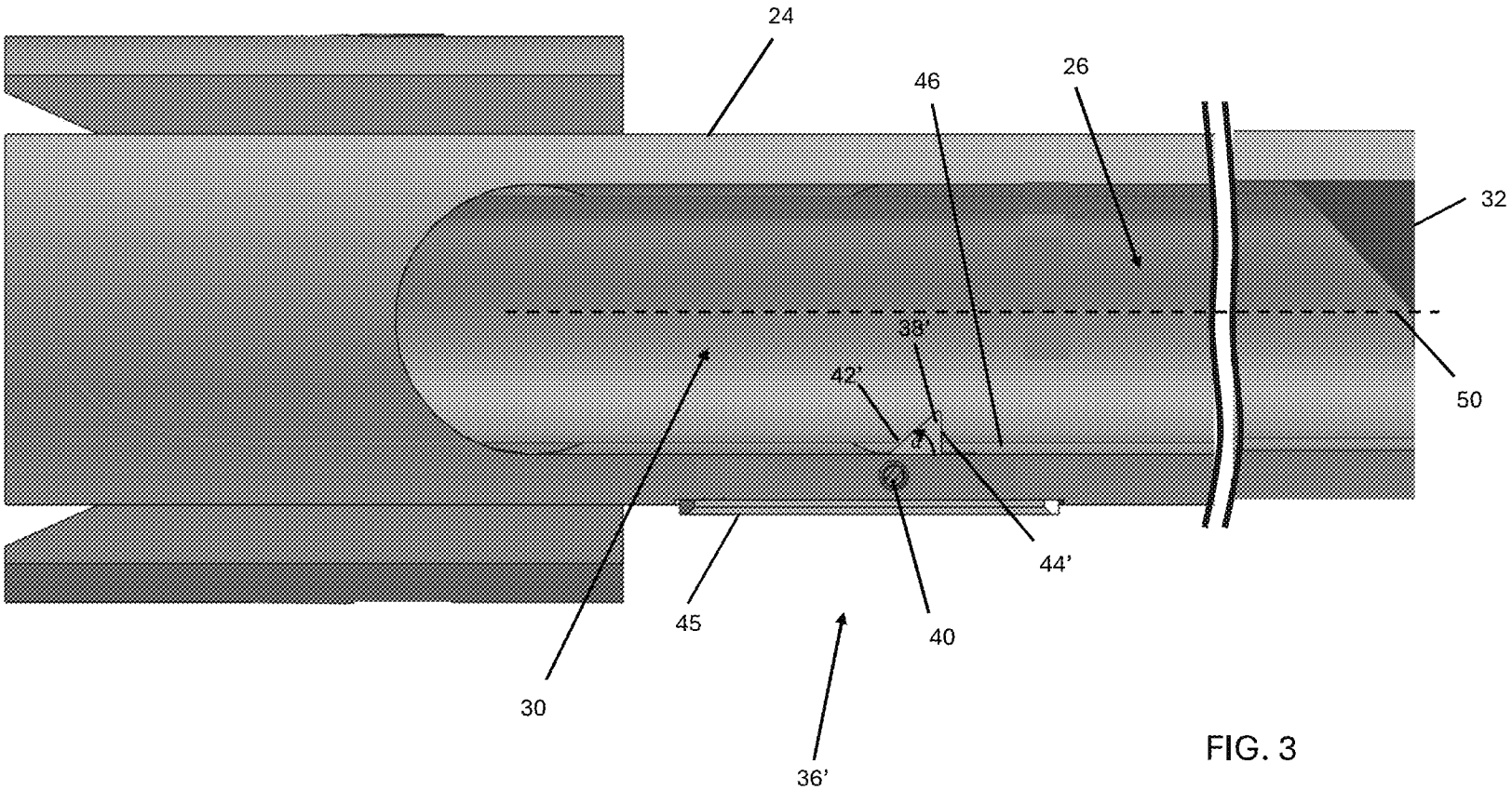
FIG. 3 is a cross-sectional view of part of the ball catcher tool according to the present disclosure, including an improved erosion-resistant retractable ball retainer.
Figure 4:
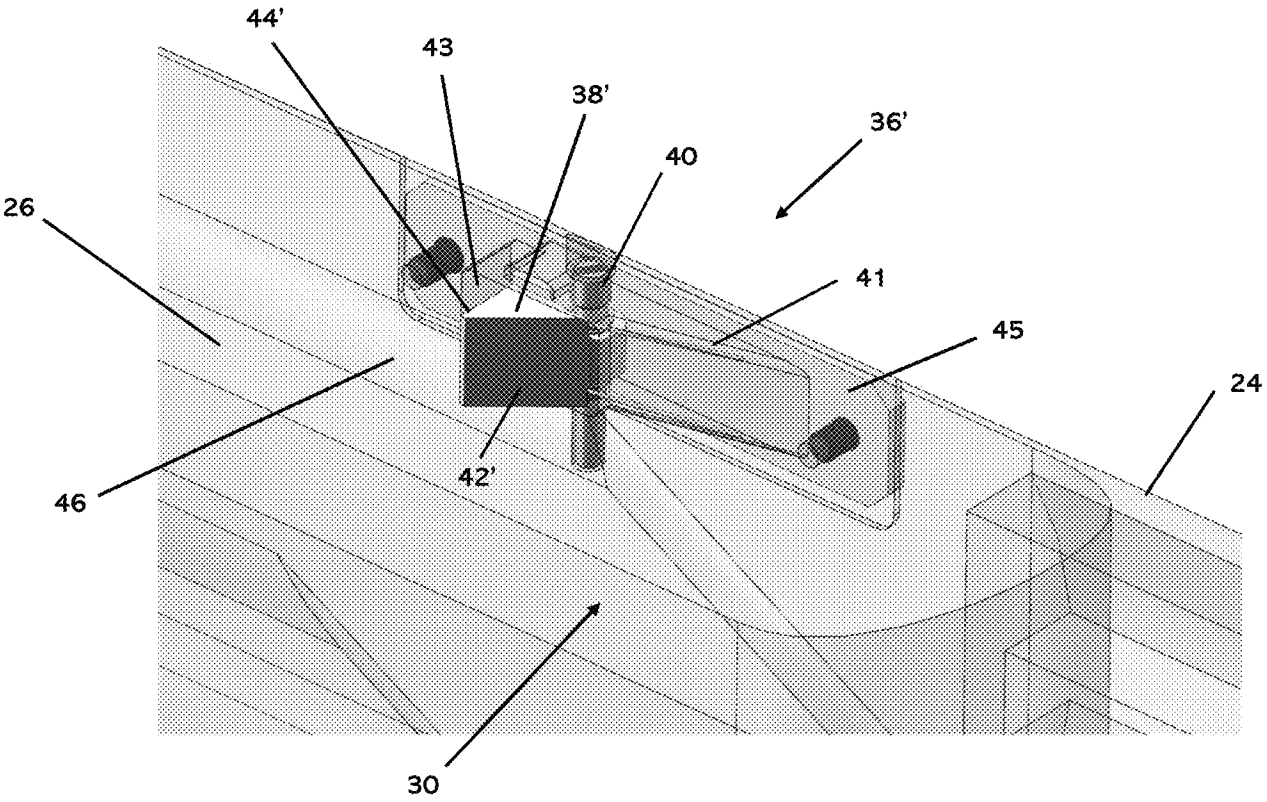
FIG. 4 is another cross-sectional view of the erosion-resistant retractable ball retainer of FIG. 3.
Figure 5:
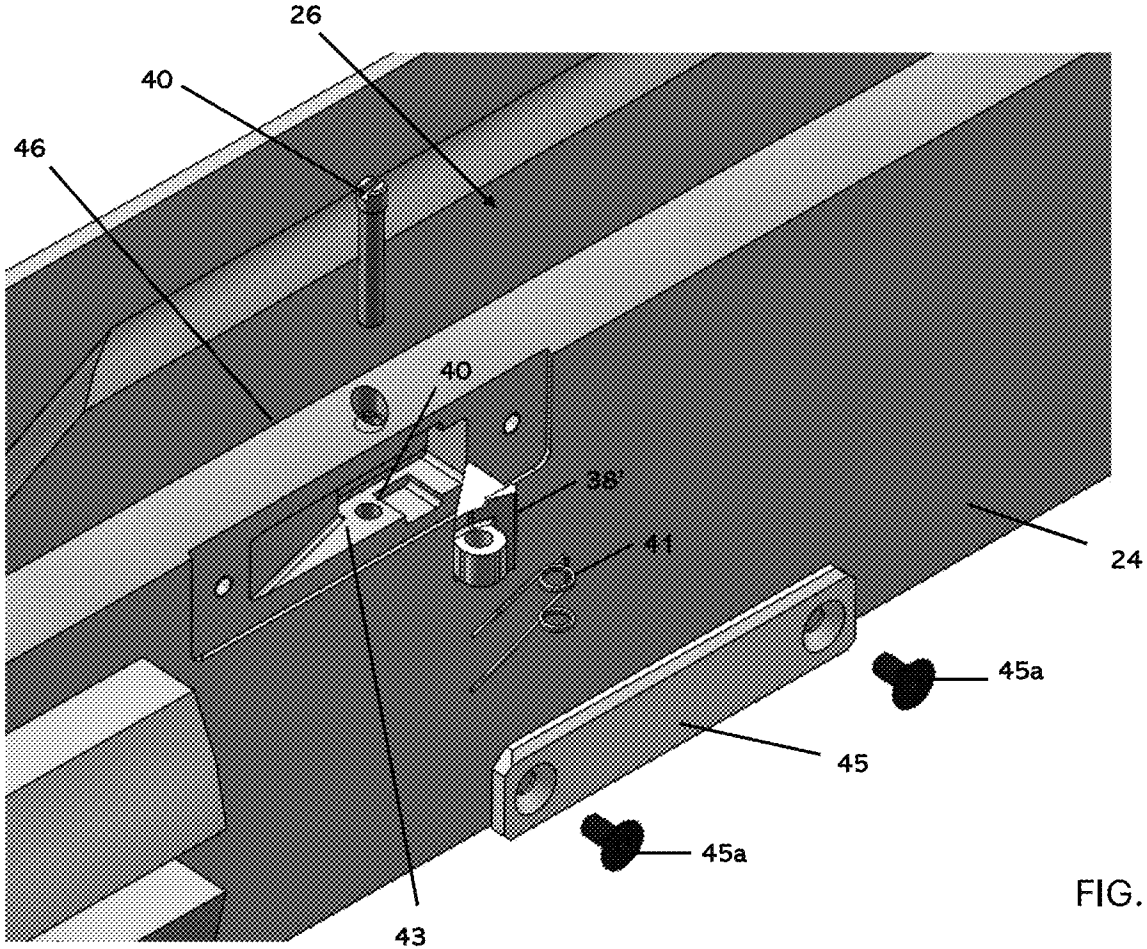
FIG. 5 is a cross-sectional exploded view of the erosion-resistant retractable ball retainer of FIG. 3.
Figure 6:
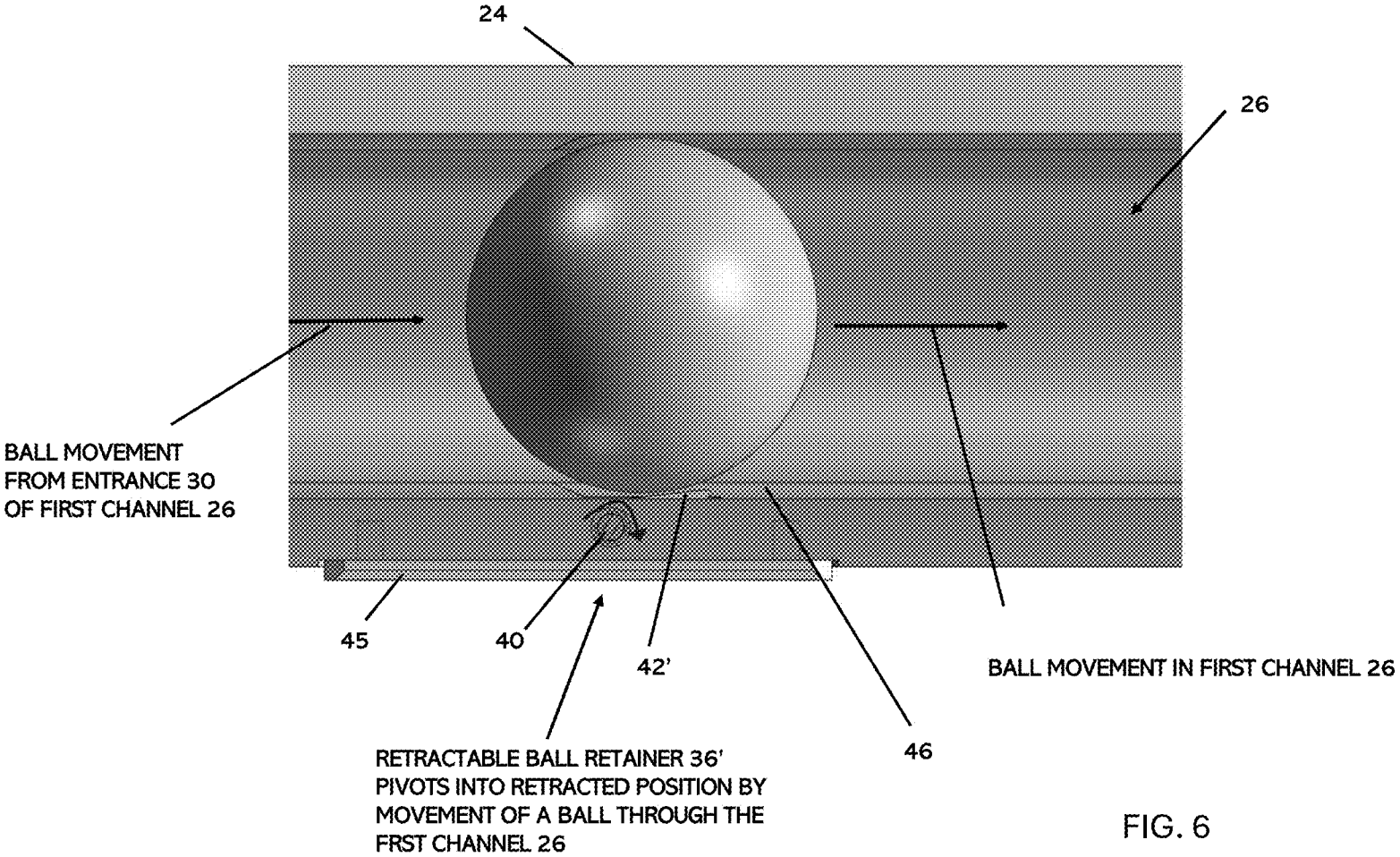
FIG. 6 is a schematic cross-sectional view illustrating retraction of the ball retainer of FIG. 3 by movement of a ball past the ball retainer.

In embodiments of the present disclosure, the ball catcher tool 10 described above with respect to FIG. 1 can be configured with an improved retractable ball retainer 36' as shown in FIGS. 3-5 of the present disclosure. The improved retractable ball retainer 36' includes a retainer block 38' that is configured to pivot about a pivot pin 40 mounted within a compartment or void space 43 formed in the sleeve 24. The retainer block 38' is configured to pivot between an extended position and a retracted position by movement of a ball past the retainer block 38'. The retractable ball retainer 36' includes a spring 41 that is held and captured by the pivot pit 40 within the compartment 43. The spring 41 is configured to interface to the retainer block 38' and apply a spring-bias force to the retainer block 38' that biases the retainer block 38' to assume the extended position where part of the retainer block 38' extends into the first channel 26. The part of the retainer block 38' that mounts to the pivot pin 40 is disposed within the compartment 43.

The retainer block 38' has a front surface 42' and rear surface 44'. In embodiments, both the front surface 42' and rear surface 44' are generally planar in form in the shape of a wedge. Other configurations can be used for the front surface 42' and rear surface 44'. In the extended position of the retainer block 38', the front surface 42' extends beyond the inside surface 46 of the sleeve 24 into the first channel 26 at an acute angle $\alpha$ relative to the inside surface 46 and away from the opening 30 of the first channel 26 as best shown in FIG. 3. In embodiments, the acute angle $\alpha$ is in the range of 20 degrees to 45 degrees. In the extended position of the retainer block 38', the rear surface 44' extends beyond the inside surface 46 of the sleeve 24 into the first channel 26 perpendicular to the inside surface 46. The rear surface 44' retains larger-size ball(s) that enter the first channel 26 at the upper end of the first channel 26. As a moving ball enters the entrance 30 of the first channel 26, it contacts the front surface 42' of the retainer block 38'. The kinetic energy of the moving ball causes the retainer block 38' to pivot about the pivot pin 40 into the retracted position within the compartment 43, which permits the ball to move pass the retainer block 38' and through the first channel 26. After the moving ball moves past the retainer block 38', the spring-bias forces applied by the spring 41 to the retainer block 38' returns the retainer block 38' to the extended configuration.

In the extended configuration of the retractable ball retainer 36', the front surface 42' of the retainer block 38' is oriented at an angle away from the opening 30 of the first channel 26. This angled orientation can reduce erosion of the retainer block 38' and the pivot pin 40 due to high velocity fluid flow through the tool 10.

In embodiments, the compartment 43 for the retainer block 38' and spring 41 can be accessed by an open wall formed in the sleeve 41 opposite the channel 26 as best shown in FIG. 5. In this embodiment, a removable plate 45 can be secured to the inner sleeve 26 (for example, by screws 45*a*) and configured to cover the compartment 43. When the plate 45 covers the compartment 43, the plate 45 can limit the flow of fluid flow through the compartment 43 and reduce erosion of the retainer block 38' and the pivot pin 40 due to high velocity fluid flow through the compartment 43.

In embodiments, the retainer block 38' can be formed from tungsten carbide. The tungsten carbide material can reduce erosion of the retainer block 38' due to high velocity fluid flow through the tool 10.

Advantageously, the ball catcher tool with the improved retractable ball retainer as described herein can increase the operational lifetime of the ball catcher tool and limit the failure of the ball catcher tool when used in conjunction with high velocity fluids.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with associated function.

What is claimed is:

1. A tool for catching and retaining drop balls in a tool string, the tool comprising:

a body having a central bore extending therethrough;

a first channel that extends within the central bore, wherein the first channel has an opening that is configured to receive at least one ball for retention in the first channel;

a retractable ball retainer that includes a retainer element configured to move between an extended position and a retracted position by movement of a ball past the retainer element, wherein the retainer element includes a front surface and a rear surface that are configured in the extended position to extend into the first channel with the front surface extending at an acute angle relative to an inside surface that forms the first channel and away from the opening of the first channel; and the rear surface is configured in the extended position to extend into the first channel perpendicular to the inside surface that forms the first channel.

2. A tool according to claim 1, wherein:

the acute angle of the front surface limits erosion of the retractable ball retainer due to high velocity fluid flow through the tool.

3. A tool according to claim 1, wherein:

the acute angle of the front surface is in the range of 20 degrees to 45 degrees.

4. A tool according to claim 1, wherein:

the front surface and the rear surface of the retainer element are generally planar in form in the shape of a wedge.

5. A tool according to claim 1, wherein:

the retainer element is configured in the retracted position to move into a compartment or void space.

6. A tool according to claim 5, wherein:

the compartment or void space is accessible by an open wall that is covered by a removable plate.

7. A tool according to claim 6, wherein:

the removable plate limits erosion of the retractable ball retainer due to high velocity fluid flow through the tool.

8. A tool according to claim 5, wherein:

the retainer element is configured to pivot between the extended position and retracted position about a pivot pin mounted within the compartment or void space.

9. A tool according to claim 7, wherein:

the retractable ball retainer includes a spring that is held and captured by the pivot pin within the compartment or void space, wherein the spring is configured to interface to the retainer element and apply a spring-bias force to the retainer element that biases the retainer element to assume the extended position where part of the retainer element extends into the first channel.

10. A tool according to claim 1, wherein:

the retainer element is formed from tungsten carbide to limit erosion of the retractable ball retainer due to high velocity fluid flow through the tool.

11. A tool according to claim 1, further comprising:

a ball diverter disposed within the central bore, wherein the ball diverter is configured to direct at least one ball that is received by the tool to the first channel; and a ball stop disposed at an end of the first channel.

12. A tool according to claim 1, further comprising:

a second channel that extends within the central bore, wherein the first channel is configured to retain at least one larger size ball in the first channel, and wherein the second channel is configured to permit passage of at least one smaller size ball therethrough.

13. A tool according to claim 12, wherein:

the first and second channels are defined by an internal sleeve disposed within the central bore.

14. A tool according to claim 12, further comprising:

at least one opening or passage between the first and second channels that permits passage of at least one smaller size ball from the first channel into the second channel.

15. In a tool for catching and retaining drop balls having a body that defines a central bore extending therethrough, and a first channel that extends within the central bore, wherein the first channel has an opening that is configured to receive at least one ball for retention in the first channel, an improvement comprising:

a retractable ball retainer that includes a retainer element configured to move between an extended position and a retracted position by movement of a ball past the retainer element, wherein the retainer element includes a front surface and a rear surface that are configured in the extended position to extend into the first channel with the front surface extending at an acute angle relative to an inside surface that forms the first channel and away from the opening of the first channel; and the retainer element is configured in the retracted position to move into a compartment or void space, and the compartment or void space is accessible by an open wall that is covered by a removable plate, wherein the removable plate limits erosion of the retractable ball retainer due to high velocity fluid flow through the tool.

16. A tool according to claim 15, wherein:

the acute angle of the front surface limits erosion of the retractable ball retainer due to high velocity fluid flow through the tool.

17. A tool according to claim 15, wherein:

the acute angle of the front surface is in the range of 20 degrees to 45 degrees.

18. A tool according to claim 15, wherein:

the front surface and the rear surface of the retainer element are generally planar in form in the shape of a wedge.

19. A tool according to claim 15, wherein:

the retainer element is formed from tungsten carbide to limit erosion of the retractable ball retainer due to high velocity fluid flow through the tool.

* * * * *